US009181602B2

(12) United States Patent
Odenthal et al.

(10) Patent No.: US 9,181,602 B2
(45) Date of Patent: Nov. 10, 2015

(54) DEVICE FOR DEGASSING MOLTEN STEEL WITH AN IMPROVED DISCHARGE NOZZLE

(75) Inventors: Hans-Jürgen Odenthal, Mettmann (DE); Dieter Tembergen, Duisburg (DE)

(73) Assignee: SMS group GMBH, Düsseldorf (DE)

( * ) Notice: Subject to any disclaimer, the term of this patent is extended or adjusted under 35 U.S.C. 154(b) by 11 days.

(21) Appl. No.: 13/392,944

(22) PCT Filed: Aug. 20, 2010

(86) PCT No.: PCT/EP2010/005124

§ 371 (c)(1),
(2), (4) Date: Feb. 28, 2012

(87) PCT Pub. No.: WO2011/023337

PCT Pub. Date: Mar. 3, 2011

(65) Prior Publication Data

US 2012/0160063 A1 Jun. 28, 2012

(30) Foreign Application Priority Data

Aug. 28, 2009 (DE) ..... 10 2009 039 260

(51) Int. Cl.

| | |
|---|---|
| ***C21C 7/10*** | (2006.01) |
| ***C22B 9/05*** | (2006.01) |
| *C21B 13/00* | (2006.01) |

(52) U.S. Cl.
CPC .. *C22B 9/055* (2013.01); *C21C 7/10* (2013.01)

(58) Field of Classification Search
USPC ..... 75/510; 266/44, 208
See application file for complete search history.

(56) References Cited

U.S. PATENT DOCUMENTS 4,979,983 A * 12/1990 Nishikawa et al. ..... 75/511

FOREIGN PATENT DOCUMENTS

| | | | | |
|---|---|---|---|---|
| CN | 2126624 | | 1/1993 | |
| DE | 19511557 | * | 2/1996 | ..... B22D 1/00 |
| DE | 19511640 | | 5/1996 | |
| GB | 2299344 | | 10/1996 | |
| JP | 57200514 | | 12/1982 | |
| JP | 1198418 | | 8/1989 | |
| JP | 1275715 | | 11/1989 | |
| JP | 01275715 | A | 11/1989 | |
| JP | 2173204 | | 7/1990 | |
| JP | 3107412 | | 5/1991 | |

(Continued)

OTHER PUBLICATIONS

Rathner R et al: "Entwicklung Von Spuelementen Fuer Entgasungsgefaesse. Development of Purge Elements for Degassing Units", Radex Rundschau, Graefelfing, DE, Nr. 4, Dec. 1, 1990, Seiten 365-376, XP002056363.

(Continued)

*Primary Examiner* — Melvin C Mayes
*Assistant Examiner* — Alexander Polyansky
(74) *Attorney, Agent, or Firm* — Lucas & Mercanti, LLP; Klaus P. Stoffel

(57) ABSTRACT

The present invention relates to a device for degassing molten steel, comprising an evacuation vessel (2), a pouring ladle (3), an inlet nozzle (4) with a gas purging device (5) arranged therein, and a discharge nozzle (1), wherein at its lower edge (9), in a radial direction in relation to the central longitudinal axis (6) of the discharge nozzle (1), the discharge nozzle (1) has at least one bore (7).

12 Claims, 3 Drawing Sheets

(56) References Cited

FOREIGN PATENT DOCUMENTS

| | | | | |
|---|---|---|---|---|
| JP | 3271315 | | 12/1991 | |
| JP | 5214426 | A | 8/1993 | |
| JP | 05214426 | A | 8/1993 | |
| JP | 06-299227 | * | 10/1994 | ..... C21C 7/10 |
| JP | 6299227 | | 10/1994 | |
| JP | 11158536 | | 6/1999 | |
| RU | 2215047 | | 10/2003 | |
| SU | 1060690 | | 12/1983 | |
| WO | 2007021207 | A | 2/2007 | |

OTHER PUBLICATIONS

Tembergen D et al: "Verbesserte Stahlumlaufsimulation beim RH-Prozess = Advanced fluid flow simulation for the RH process", Stahl Uno Eisen, Verlag Stahleisen, Dusseldorf, DE, Bd. 129, Nr. 10, Oct. 15, 2009, Seiten 41-52, XP001556565.

* cited by examiner

DEVICE FOR DEGASSING MOLTEN STEEL WITH AN IMPROVED DISCHARGE NOZZLE

The present application is a 371 of International application PCT/EP2010/005124, filed Aug. 20, 2010, which claims priority of DE 10 2009 039 260.2, filed Aug. 28, 2009, the priority of these applications is hereby claimed and these applications are incorporated herein by reference.

BACKGROUND OF THE INVENTION

The present invention relates to a device for degassing molten steel with an improved outlet nozzle. In particular, the present invention relates to a special shape of an outlet nozzle for avoiding local dead water regions in a steel casting ladle. The present invention further relates to a method for degassing liquid steel with the improved outlet nozzle.

The method for degassing liquid steel is an RH-method (Ruhrstahl-Heraeus method). In the RH-method, the liquid steel is conveyed from a casting ladle in a riser pipe into an evacuation vessel. A conveying gas, in particular argon, is introduced into the riser pipe above the level of the steel bath. The argon flow introduced into the riser pipe through several nozzles, disintegrates into a plurality of argon bubbles which rise in the immediate vicinity of the wall. The conveyance of the liquid steel is facilitated by the volume enlargement because of argon in the riser pipe and by the pressure difference between the outer air pressure and the negative pressure in the evacuation vessel. The argon bubbles entrain the molten steel and ensure a uniform circulation of the molten steel. The partial pressure is simultaneously lowered and the decarburization reaction is accelerated. The steel taken into the evacuation vessel is sprayed. As a result, a significant surface increase and a good degassing of the liquid steel occur.

Oxygen, which during the entire treatment time is taken in simultaneously and is, among others, supplied from the slag, leads to the formation of carbon monoxide (CO). CO is degassed in the vacuum vessel, so that the desired decarburization is achieved. The fine decarburization to values which are as low as possible can be optimized by oxygen which is additionally blown in. A high circulating speed of the molten steel and, thus, an increase of the conveying gas flow and an increase of the nozzle diameter of the vacuum plant, lead to a faster decarburizing sequence.

DE 19511640 C1 discloses a nozzle for a degassing vessel with a refractory lining and a gas rinsing device with several ducts arranged in the lining. The ducts are distributed over the circumference of the nozzle and extend, in relation to the center longitudinal axis of the nozzle, through the refractory lining in a radial direction. The ducts can be connected at the outer side to at least one gas supply line.

For forming an almost continuous gas veil, the ducts are arranged in close sequence circumferentially along the inner wall of the nozzle. A uniform flow of liquid steel is achieved up to and into the vacuum vessel. The gas supply which is distributed over the entire circumference facilitates, preferably through fine bubbles, an especially fine distribution of the treatment gas with a simultaneously significantly increased reaction volume between treatment gas and molten steel. In this manner, a higher and faster decarburizing output is achieved, so that smaller quantities of reduction media are necessary.

JP 6299227 A discloses a method for manufacturing steel with very low carbon content by means of a degassing device, wherein the inlet nozzle is positioned such that the distance between the axis of the inlet nozzle and the axis of the metal bath is at least 10% of the inner diameter of the metal bath.

JP 1198418 A discloses a device and a method for vacuum degassing of molten steel, wherein gas is introduced into the inlet nozzle and the outlet nozzle, and the function of the nozzle can be alternated.

JP 57200514 A discloses a method for degassing molten steel, wherein the degassing effect is improved by degassing an RH-vacuum apparatus, in which an inert gas is blown into a molten steel vessel from the bottom.

JP 3271315 A discloses an RH-vacuum decarburizing method of noble steel, wherein degassing and decarburizing are achieved in a short time and the chromium loss is reduced. The result is achieved by using steel having a low silicon content and by repeated degassing and decarburizing procedures with an RH-vacuum vessel.

JP 2173204 A discloses a vacuum vessel for an RH degassing device, wherein an ultrasound oscillator is mounted at a contact point with the liquid steel in the vacuum vessel, for destroying bubbles which are produced by the blowing in of gas, and for improving the reaction surface at the phase reaction.

JP 11158536 A discloses a method for melting steel having a very low carbon content, wherein an inert gas is blown through the inlet pipe below the added aluminum into the vessel at the outlet nozzle for circulation after decarburizing.

JP 3107412 A discloses a method for manufacturing steel with a very low carbon content, wherein during decarburizing, argon is blown simultaneously into the inlet as well as the outlet pipe.

It has been found, and is confirmed by numeric simulations, that in the steel casting ladle of an RH plant local flow regions, so-called dead water regions, are formed which are mixed relatively late, only after about two minutes, with the remaining molten steel.

The devices and methods known in the prior art have the disadvantage that dead water regions are formed in the steel casting ladle which increase the homogenization time of the molten steel.

A dead water region is usually formed between the outlet nozzle and the refractory wall of the casting ladle. Through the downwardly directed jet of molten steel from the outlet nozzle, a small quantity of material is taken in from the direct surroundings around the outlet nozzle. Consequently, because of the delayed homogenization, the carbon concentration remains altogether at a high level at this location. The dead water region mixes poorly with the remaining molten steel because the average flow velocity is low. Because of the low exchanges of mass, pulse and energy between the dead water region with high carbon concentration and the remaining molten steel with low carbon concentration, the molten steel in the ladle must be frequently circulated until the desired final carbon content is achieved. Since the molten steel in the ladle must circulate frequently, the treatment time is long.

SUMMARY OF THE INVENTION

The invention is based on the object of making available a device for degassing molten steel with an improved outlet nozzle which reduces the formation of dead water regions.

The invention is based on the object to make available an improved and reliable method for degassing and/or decarburizing molten steel, wherein the formation of dead water regions is reduced.

The object of the present invention is met by a device which comprises at least one degassing vessel, a steel casting ladle, an inlet nozzle, and a gas rinsing device arranged therein, and an outlet nozzle. The outlet nozzle has at the lower edge in a radial direction, in relation to the center longitudinal axis of the outlet nozzle, at least one bore. The device is preferably an RH plant.

As a consequence of the developing Venturi effect, the carbon-containing molten steel is suctioned from the dead water region between the outlet nozzle and the ladle closure, and is conducted into the downward flow of the outlet nozzle.

The size and number of bores at the bottom edge depend on the respective RH method and must be adapted thereto. Significant parameters are the geometry and immersion depth of the inlet and outlet nozzles as well as the negative pressure in the RH-vacuum vessel.

It must be ensured that not too much molten steel is transported from the outside into the outlet nozzle and, as a result, any slag which may possibly float on the top is also suctioned in from the free surface of the steel casting ladle.

By using the device according to the invention, particularly the new shape of the outlet nozzle, the local dead water region is reduced in its dimensions. The treatment and circulation time of the molten steel can be shortened in an advantageous manner. This leads to an advantageous lowering of the argon consumption and to a further cost reduction. The productivity of the RH plant is increased.

A preferred development of the invention is an outlet nozzle which has several bores (7) along a circle of 360 degrees. Particularly preferably, the nozzle outlet has several bores along a circle of 180 degrees in the direction of the refractory wall of the casting ladle. The configuration of the outlet nozzle according to the invention, effectively reduces the local dead water regions.

The size and the number of bores are dependent on the geometry and the immersion depth of the outlet nozzle as well as the negative pressure in the evacuation vessel.

Another preferred development of the invention is an outlet nozzle in which the bores have a diameter of 10 mm to 50 mm, preferably 25 mm to 35 mm. With these diameters for the bores, good results in the dead water reduction are achieved.

Another preferred embodiment of the invention is an outlet nozzle whose immersion depth in the molten steel in the casting ladle is 300 mm to 1,200 mm, preferably 400 mm to 1,000 mm. In this range of the immersion depth, good results in the dead water reduction are achieved.

Another preferred embodiment of the invention is an outlet nozzle, wherein one or more bores are arranged 50 mm to 900 mm, preferably 100 mm to 700 mm above the bottom edge of the outlet nozzle. As a result, the vertical distance between the bores and the ladle slag becomes as large as possible. It is prevented that ladle slag is suctioned into the outlet nozzle.

Another preferred embodiment of the invention is an outlet nozzle in which bores are located in a row of bores, or several rows of bores, arranged one above the other in the outlet nozzle. Preferred are one or two rows of bores located above each other at the outlet nozzle.

The object of the present invention is met by a method for degassing molten steel, wherein a) a conveying gas, especially argon, is introduced above the steel bath level into an inlet nozzle, b) liquid steel is suctioned from a casting ladle into the inlet nozzle, c) liquid steel is conveyed from the inlet nozzle into an evacuation vessel located above the inlet nozzle, d) liquid steel is degassed and decarburized, and e) liquid steel is conveyed through an outlet nozzle into the casting ladle, wherein the outlet nozzle has at least one bore at the bottom edge in the radial direction in relation to the center longitudinal axis of the outlet nozzle.

The object of the present invention is further met by the use of the outlet nozzle according to the invention in an RH plant for reducing local dead water regions in a casting ladle. By using the outlet nozzle according to the invention, local dead water regions are effectively reduced.

The invention will be explained in further detail with the aid of a drawing. The drawing shows an embodiment of the invention.

DETAILED DESCRIPTION OF THE INVENTION

Figure 1:
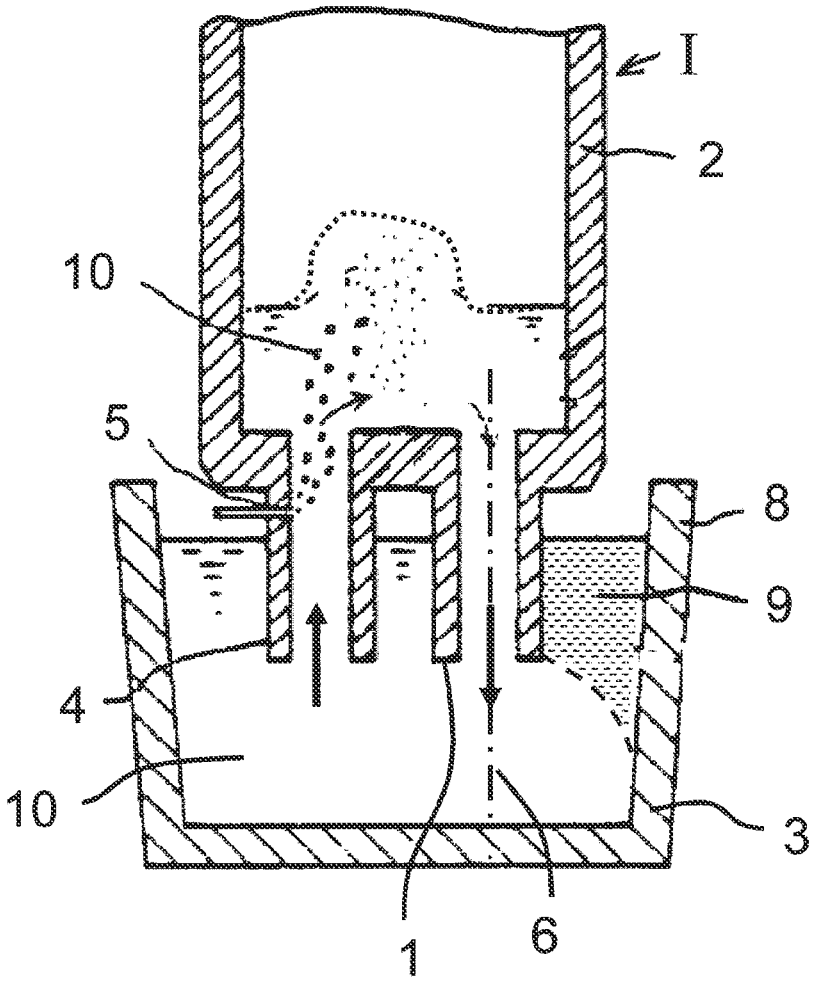
FIG. 1 is a cross sectional view of an RH plant according to the prior art without bores in the outlet nozzle and with a local dead water region between the outlet nozzle and the refractory wall of the casting ladle.

The RH plant I shown in FIG. 1 includes a steel casting bath 3 with a volume of 200 t. The immersion depth of the outlet nozzle 1 and the inlet nozzle 4 was 600 mm each. The process time was 85 s. The following method steps were carried out in the RH plant. Argon 5 was introduced above the level of the steel bath 10 into the inlet nozzle 4. The liquid steel 10 was suctioned from the casting ladle 3 into the inlet nozzle 4. The liquid steel 10 was conveyed from the inlet nozzle 4 into the evacuation vessel 2 located thereabove. The liquid steel 10 was degassed in the evacuation vessel 2. The liquid steel 10 was conveyed through the outlet nozzle 1 back into the casting ladle 3. A local dead water region 9 was formed between the outlet nozzle 4 and the refractory wall 8 of the casting ladle 3. Using the downwardly directed jet of molten steel from the outlet nozzle 4, a small quantity of molten steel 10 was suctioned from the direct surroundings around the outlet nozzle 1. As a consequence, the carbon concentration in the dead water region 9 remained at an altogether high level because of the delayed homogenization. The dead water region 9 mixed poorly with the remaining molten steel 10 because the average flow velocity was low. The duration of the method was long.

Figure 2:
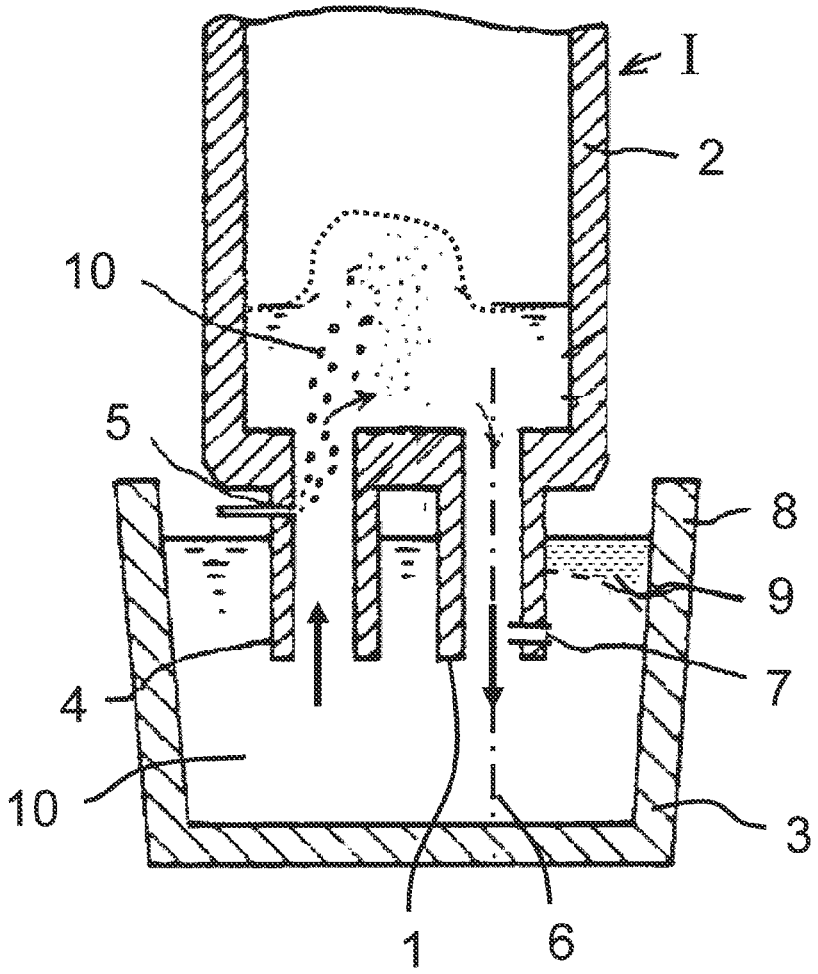
FIG. 2 is a cross sectional view of an RH plant, according to the invention, with bores in the outlet nozzle and with a reduced local dead water region between the outlet nozzle and the refractory wall of the casting ladle.

FIG. 2 shows a cross sectional view of an RH plant I with bores 7 in the outlet nozzle 1 and with a significantly reduced local dead water region 9 between the outlet nozzle 1 and the refractory wall 8 and the casting ladle 3. The method sequence was the same as in the example in FIG. 1 with the following differences. The outlet nozzle 1 had several bores 7 in the radial direction in relation to the center longitudinal axis 6 of the outlet nozzle 1 on the side toward the refractory wall 8 of the casting ladle 3. The bores 7 were arranged 150 mm above the bottom edge of the outlet nozzle 1. The immersion depth of the outlet nozzle H snorkel was 400 mm. Molten steel 10 was suctioned from the direct vicinity of the outlet nozzle 1. The homogenization in the molten steel 10 took place more quickly. Consequently, the carbon concentration in the dead water region 9 dropped. The duration of the method was significantly reduced as a result.

Figure 3:
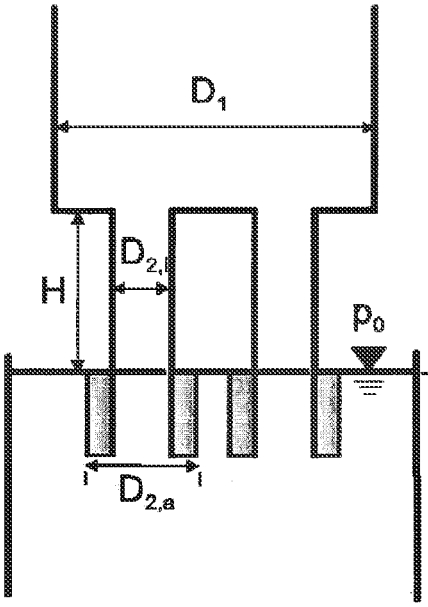
FIG. 3 is a cross sectional view of an RH plant according to the invention in a state of rest.
Figure 4:
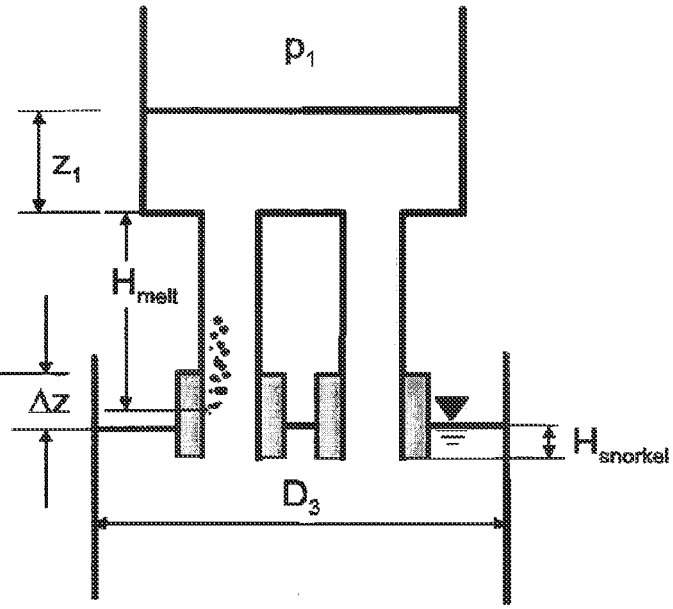
FIG. 4 is a cross sectional view of an RH plant according to the invention in a state of operation.

FIGS. 3 and 4 illustrate the following example. Initially, the geometry of an RH plant was explained in Table 1 and the physical variables in Table 2.

TABLE 1

| | Geometry of the RH plant | Measurement | Unit |
|---|---|---|---|
| $H_{melt}$ | Distance from the lower edge of the degassing vessel up to the gas inlet | 1.350 | meters |
| $D_1$ | Diameter of the degassing vessel | 2.200 | meters |
| $D_{2a}$ | External diameter of the inlet nozzle and the outlet nozzle | 1.294 | meters |
| $D_{2i}$ | Internal diameter of the inlet nozzle and the outlet nozzle | 0.650 | meters |
| $D_3$ | Diameter of the casting ladle | 3.396 | meters |
| $H_{snorkel}$ | Immersion depth of the outlet nozzle | 0.6 | meters |
| $h_{nozzle}$ | Distance of the bore from the bottom edge of the outlet nozzle | 0.275 | meters |

TABLE 2

| | Physical variables | Measurement | Unit |
|---|---|---|---|
| $P_0$ | Pressure in the casting ladle in the state of rest | 100.000 | Pa |
| $P_{RH}$ | Pressure in the degassing vessel | 200 | Pa |
| $r_{ho}$ | Density of the molten steel | 6930-7050 | $Kg/m^3$ |
| T | Temperature of the molten steel | 1600 | ° C. |

The negative pressure in the RH vessel is reduced gradually, for example, from initially 250 mbar down to 2 mbar within about 6 min. The pressure of 2 mbar is also the lowest pressure in the RH vessel, particularly above the molten steel surface in the RH vessel.

The cycle time in an RH plant is about 10 min. to 50 min. The homogenization time is approximately 90 s to 480 s in the molten steel with an outlet nozzle without bores. The homogenizing time in the molten steel with an outlet nozzle with bores is about 85 s to 456 s. This means that the cycle time is reduced by about 5%.

The number n of bores is preferably 3 to 9. The number is preferably odd because the central bore should be located on the axis and, thus, in the narrowest gap between the refractory lining of the ladle and the nozzle.

The angle α between the bores is dependent on the number n of bores. In the case of up to three bores, α=10°-20°. This causes a targeted suctioning of the dead water from the area between the ladle closure and the nozzle wall. In the case of up to 9 bores, α=7.5°-11.25°. This corresponds to a covered range of 60° to 90°.

The preferred bore diameter is 10 mm to 50 mm.

In the case of a conventional immersion depth of the outlet nozzle of $H_{snorkel}$=600 m, the row of bores should be positioned at most 300 mm above the outlet opening of the outlet nozzle. The row of bores in the vertical direction should not be located closer than 300 mm below the molten steel surface in the steel casting ladle because otherwise there is the danger that slag is also taken from the surface.

In the case of immersion depth greater than 600 mm, it is alternatively possible to arrange two or more rows of bores one above the other, see Table 2.

Also advantageous is a single vertical row of bores in the space between the outer wall of the nozzle and the refractory lining of the ladle. In this manner, the entire dead space material which collects primarily at this location, is suctioned in a targeted manner into the nozzle.

Moreover, the bores in the outlet nozzle can also be arranged between the two nozzles because quieted molten steel material also collects in this area.

Characteristic parameters when varying the immersion depth of the outlet nozzle are shown in Table 3 in connection with the example of the inner diameter $D_i$=650 mm of the inlet and the negative pressure in the RH vessel 2 mbar.

TABLE 3

| Immersion Depth[E)] $H_{snorkel}$ in mm | Number[A)] m | Spacing[V)] H in mm | Number[B)] N | Angle[W)] α in ° | Bore Diameter[D)] D in mm |
|---|---|---|---|---|---|
| 400 | 1 | 100 | 3 | 10 | 30 |
| 600 | 1 | 300 | 5 | 15 | 30 |
| 800 | 2 | 200 | 3 | 10 | 30 |
| | | 500 | 5 | 15 | |
| 1000 | 2 | 100 | 3 | 10 | 30 |
| | | 400 | 5 | 10 | |
| | | 700 | 5 | 15 | |

[E)]Immersion depth of the outlet nozzle
[A)]Number of bores at the outlet nozzle located in rows above each other
[V)]Vertical distance between the bottom edge of the nozzle and the rows of bores
[B)]Number of bores
[W)]Angle between the bores
[D)]Bore diameters

LIST OF REFERENCE NUMERALS

I RH degassing plant
1 Outlet nozzle
2 Evacuation vessel/vacuum vessel
3 Casting ladle/steel casting ladle/melting vessel
4 Inlet nozzle/rising pipe
5 Gas rinsing device/inert gas/argon
6 Center longitudinal axis
7 Bore
8 Refractory wall
9 Dead water region
10 Molten steel
$P_0$ Pressure in the casting ladle in the state of rest
$P_{RH}$ Pressure in the degassing vessel
$H_{melt}$ Distance from the bottom edge of the degassing vessel to the gas inlet
$D_1$ Diameter of the degassing vessel
$D_{2a}$ Outer diameter of the inlet nozzle and the outlet nozzle
$D_{2i}$ Inner diameter of the inlet nozzle and the outlet nozzle
$D_3$ Diameter of the casting ladle
rho Density of the molten steel
$H_{snorkel}$ Immersion depth of the outlet nozzle
$h_{nozzle}$ Distance of the bore from the bottom edge of the outlet nozzle
H Distance from the bottom edge of the degassing vessel
$Z_1$ Rise of the molten steel
Δz Distance from the bottom edge of the degassing vessel and gas inlet
T Temperature of the molten steel

The invention claimed is:

1. A device for degassing molten steel, comprising an evacuation vessel; a casting ladle; an inlet nozzle with a gas rinsing device arranged therein; and an outlet nozzle having a wall, wherein the outlet nozzle has at least one bore that extends through the wall of the outlet nozzle at a bottom edge in a radial direction in relation to a center longitudinal axis of the outlet nozzle, the at least one bore being configured and arranged to suction molten steel from a vicinity directly external the outlet nozzle.

2. The device according to claim 1, wherein the outlet nozzle has several bores.

3. The device according to claim 1, wherein the outlet nozzle has several bores along a circle of 360°.

4. The device according to claim 1, wherein the outlet nozzle has several bores along a semi-circle of 180° in a direction of a refractory wall of the casting ladle.

5. The device according to claim 2, wherein the bores have a diameter of 10 mm to 50 mm.

6. The device according to claim 5, wherein the bores have a diameter of 25 mm to 35 mm.

7. The device according to claim 1, wherein the outlet nozzle has an immersion depth in molten steel in the casting ladle of 300 mm to 1,200 mm.

8. The device according to claim 7, wherein the immersion depth of the outlet nozzle in the molten steel in the casting ladle is 400 mm to 1,000 mm.

9. The device according to claim 1, wherein the at least one bore is arranged 50 mm to 900 mm above the bottom edge of the outlet nozzle.

10. The device according to claim 9, wherein the at least one bore is arranged 100 mm to 700 mm above the bottom edge of the outlet nozzle.

11. The device according to claim 2, wherein the bores are arranged in a row of bores at the outlet nozzle.

12. The device according to claim 2, wherein the bores are arranged in several rows of bores located above each other at the outlet nozzle.

* * * * *